US010012390B2

(12) United States Patent
Bake et al.

(10) Patent No.: US 10,012,390 B2
(45) Date of Patent: Jul. 3, 2018

(54) COMBUSTION CHAMBER OF A GAS TURBINE WITH BOLTED COMBUSTION CHAMBER HEAD

(71) Applicant: Rolls-Royce Deutschland Ltd & Co KG, Blankenfelde-Mahlow (DE)

(72) Inventors: Sebastian Bake, Berlin (DE); Carsten Clemen, Mittenwalde (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 246 days.

(21) Appl. No.: 14/791,662

(22) Filed: Jul. 6, 2015

(65) Prior Publication Data

US 2016/0010869 A1 Jan. 14, 2016

(30) Foreign Application Priority Data

Jul. 9, 2014 (DE) ..... 10 2014 213 302

(51) Int. Cl.

| | |
|---|---|
| ***F23R 3/60*** | (2006.01) |
| ***F23R 3/00*** | (2006.01) |
| ***F23M 5/02*** | (2006.01) |

(52) U.S. Cl.

CPC ..... *F23R 3/60* (2013.01); *F23M 5/02* (2013.01); *F23R 3/002* (2013.01); *F23M 2700/0053* (2013.01); *F23R 2900/00017* (2013.01)

(58) Field of Classification Search

CPC .. F23R 3/002; F23R 3/60; F23R 3/283; F23R 3/10; F23R 2900/00017; F23R 2900/03043; F23R 2900/03045; F02C 7/24; F02C 7/20; F05D 2240/91; F05D 2260/30

See application file for complete search history.

(56) References Cited

U.S. PATENT DOCUMENTS

| | | | | |
|---|---|---|---|---|
| 4,870,818 | A | 10/1989 | Suliga | |
| 5,924,288 | A | 7/1999 | Fortuna et al. | |
| 5,934,066 | A | 8/1999 | Schmid et al. | |
| 6,672,067 | B2 | 1/2004 | Farmer et al. | |
| 6,679,063 | B2 * | 1/2004 | Ebel | F23R 3/10 60/747 |
| 7,222,488 | B2 | 5/2007 | Farmer et al. | |

(Continued)

FOREIGN PATENT DOCUMENTS

| | | |
|---|---|---|
| DE | 19643028 | 4/1998 |
| DE | 10048864 | 4/2002 |

(Continued)

OTHER PUBLICATIONS

German Search Report dated Apr. 22, 2015 from counterpart German App No. 10 2014 213 302.5.

(Continued)

*Primary Examiner* — Andrew Nguyen

(74) *Attorney, Agent, or Firm* — Shuttleworth & Ingersoll, PLC; Timothy J. Klima

(57) ABSTRACT

A combustion chamber of a gas turbine having a head plate and a combustion chamber head, where the head plate is connected to the combustion chamber, and where several heat shields arranged in the interior of the combustion chamber are bolted to the head plate, characterized in that each heat shield and the combustion chamber head are fastened to the head plate by means of joint bolted connections.

15 Claims, 6 Drawing Sheets

(56) References Cited

U.S. PATENT DOCUMENTS

Figure 1:
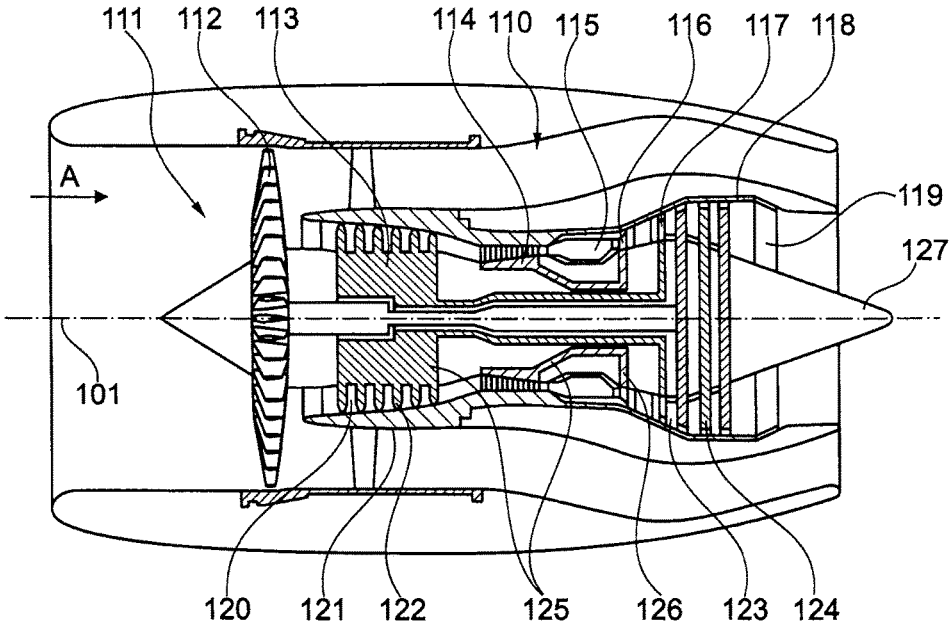

| | | | | |
|---|---|---|---|---|
| 2004/0045301 | A1 | 3/2004 | Farmer et al. | |
| 2008/0236164 | A1* | 10/2008 | Bunel | F23R 3/10 60/740 |
| 2011/0000216 | A1* | 1/2011 | Imamura | F23R 3/14 60/748 |
| 2013/0247575 | A1 | 9/2013 | Patel et al. | |
| 2014/0338347 | A1* | 11/2014 | Gage | F23R 3/06 60/754 |

FOREIGN PATENT DOCUMENTS

| | | | |
|---|---|---|---|
| EP | 0550953 | | 7/1993 |
| EP | 0837286 | A2 | 4/1998 |
| EP | 1193451 | A2 | 4/2002 |
| JP | 2004101174 | | 4/2004 |
| WO | WO03044433 | A1 | 5/2003 |

OTHER PUBLICATIONS

European Search Report dated Nov. 10, 2015 for related Application No. 15175908.1.

* cited by examiner

COMBUSTION CHAMBER OF A GAS TURBINE WITH BOLTED COMBUSTION CHAMBER HEAD

This application claims priority to German Patent Application 102014213302.5 filed Jul. 9, 2014, the entirety of which is incorporated by reference herein.

This invention relates to a combustion chamber of a gas turbine.

In detail, the invention relates to a combustion chamber of a gas turbine having a head plate, to the inside of which heat shields are attached by means of bolted connections. The combustion chamber furthermore has a combustion chamber head.

A wide range of designs is known from the state of the art in which the combustion chamber head is welded to the combustion chamber wall. The combustion chamber head is here either manufactured as a complete ring by means of a casting method, or made in segments which are then welded together to form a complete ring and subsequently joined to the combustion chamber wall too by means of a welded connection. It is also known to shape the combustion chamber head out of sheet metal and bolt it to the combustion chamber outer wall. Designs of this type are known from U.S. Pat. No. 6,672,067 B2, US 2004/0045301 A1, JP 2004101174 A, U.S. Pat. No. 5,924,288 and EP 0 550 953 A1.

In the previously known designs, it has proved disadvantageous that cast or welded combustion chamber heads require a high production expenditure and hence entail high costs. A further disadvantage is that combustion chamber heads of this type are firmly connected to the combustion chamber so that replacement is not possible. The bolted combustion chamber heads known from the state of the art have the disadvantage that they are connected to the combustion chamber outer wall. This requires additional measures at the combustion chamber outer wall to permit the bolted connections, and this increases both, design expenditure and production expenditure.

The object underlying the present invention is to provide a combustion chamber of a gas turbine of the type specified at the beginning, which while being simply designed and easily and cost-effectively producible is characterized by an inexpensive and technically advantageous embodiment of the combustion chamber head.

It is a particular object to provide a solution to the above problems by a combination of features as disclosed herein. Further advantageous embodiments will be apparent from the present disclosure.

In accordance with the invention, it is thus provided that each heat shield and the combustion chamber head are fastened to the head plate by means of joint bolted connections.

The inventive solution is characterized by a variety of considerable advantages. In accordance with the invention, the head plates are bolted to the heat shield. For that purpose, threaded bolts are provided on the heat shields, which are mostly designed as castings, and are passed through recesses of the head plate and bolted from outside the combustion chamber interior. With the solution in accordance with the invention it is provided that some of these bolted connections are used to fasten the combustion chamber head. It is thus not necessary in accordance with the invention to take additional fastening measures. Instead, the already provided bolted connections for fastening the heat shield to the head plate can also be used for mounting and fastening the combustion chamber head. It is particularly advantageous here when each heat shield is connected to the head plate by means of several bolted connections, and only some of these bolted connections are used for fastening the combustion chamber head. During assembly of the combustion chamber, it is thus possible to mount the heat shields initially by means of individual bolted connections. Once the assembly work on the combustion chamber has progressed so far that the combustion chamber head can be fitted, the still remaining fastening points can be used for bolting the combustion chamber head and for the remaining fastenings of the heat shields. The combustion chamber head is here bolted to the head plate using the provided stud bolts of the heat shields.

It is particularly favourable when the combustion chamber head is provided with access recesses for access to the bolted connection. The combustion chamber head thus preferably has several access recesses to afford access to the threaded stud bolts of the head plate and to screw nuts onto them.

In a particularly advantageous development of the invention, it is provided that the combustion chamber head in the area of the access recesses has fastening sleeves projecting into the interior of the combustion chamber head. These sleeves also double as spacers to be placed against the head plate. This results in precise alignment and assembly of the combustion chamber head. The fastening sleeves are preferably designed such that they are provided with air passage openings. This permits an even flushing of the combustion chamber head interior with cooling air.

In accordance with the invention, the combustion chamber head can be either designed as a complete ring or produced in segments. With segmented production, the individual segments can be bolted in the manner described above to the heat shield or the head plate, respectively.

In a particularly favourable development of the invention, it is provided that the combustion chamber head is manufactured by means of an additive production method, for example by means of a DLD process (direct laser depositioning). This results in a considerable reduction in the production costs. A weight optimization is also possible.

As mentioned above, the embodiment in accordance with the invention offers the option of bolting the combustion chamber head to the head plate and to the heat shield without additional parts being required. This results in a considerable weight reduction. Moreover, assembly is simplified and the overall manufacturing costs can be reduced.

Figure 2:
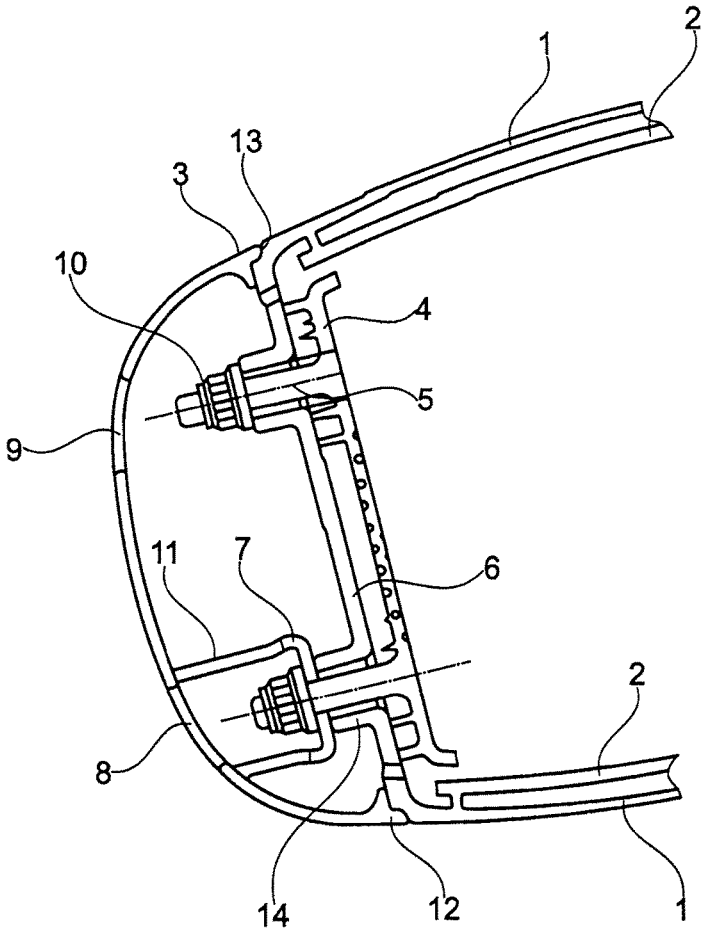
Figure 3:
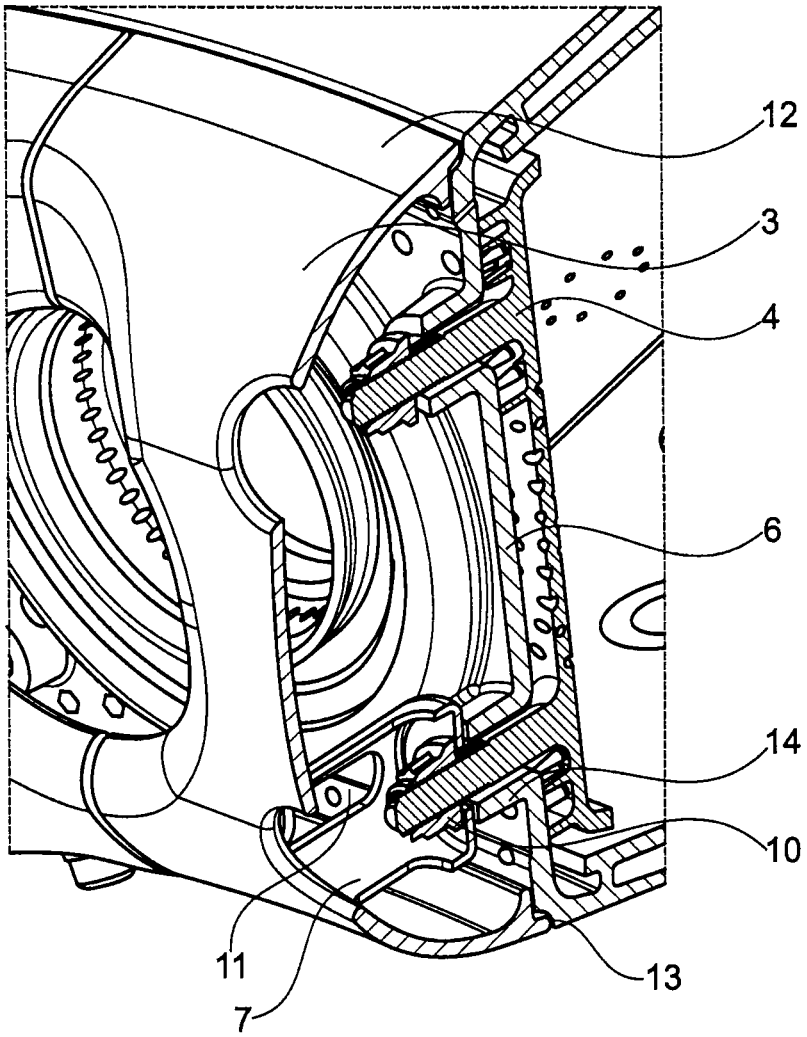
Figure 4:
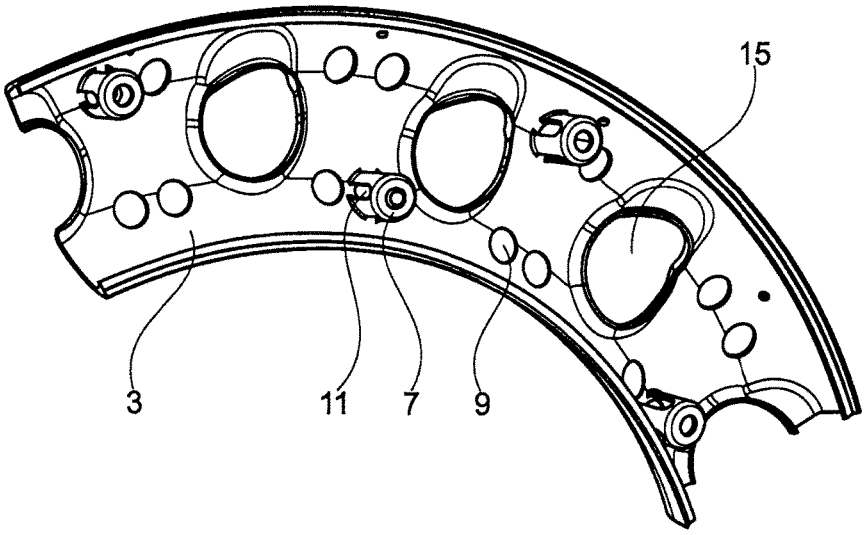
Figure 5:
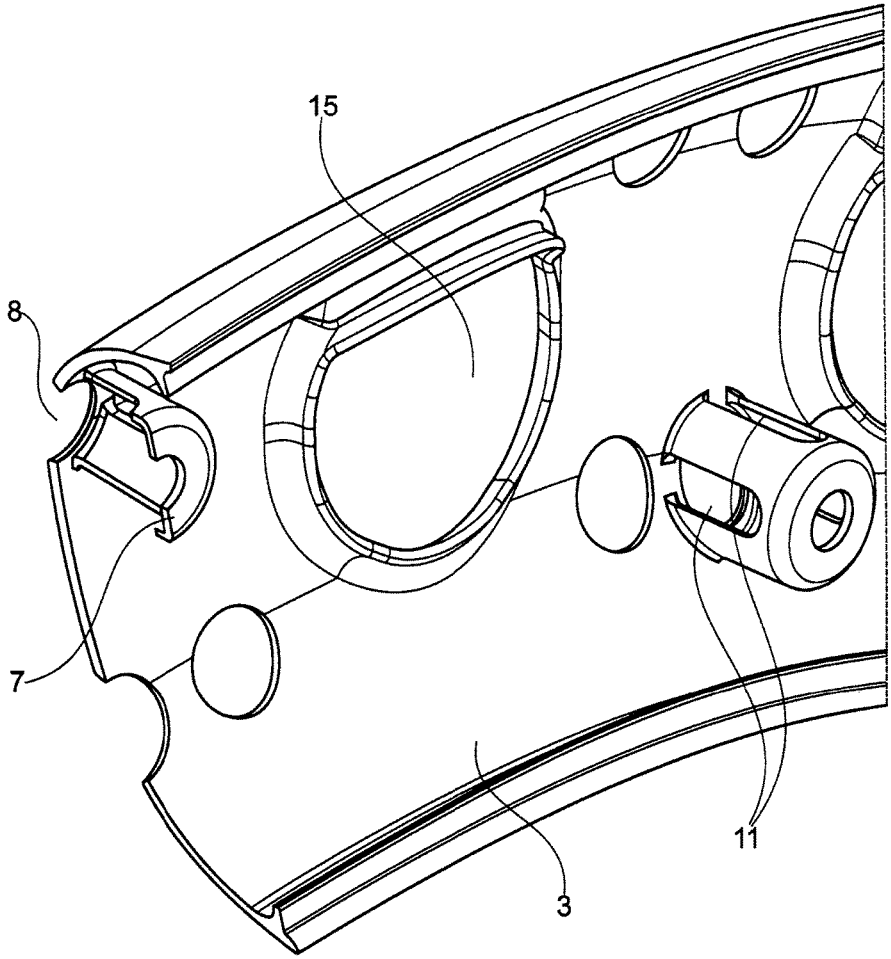
Figure 6:
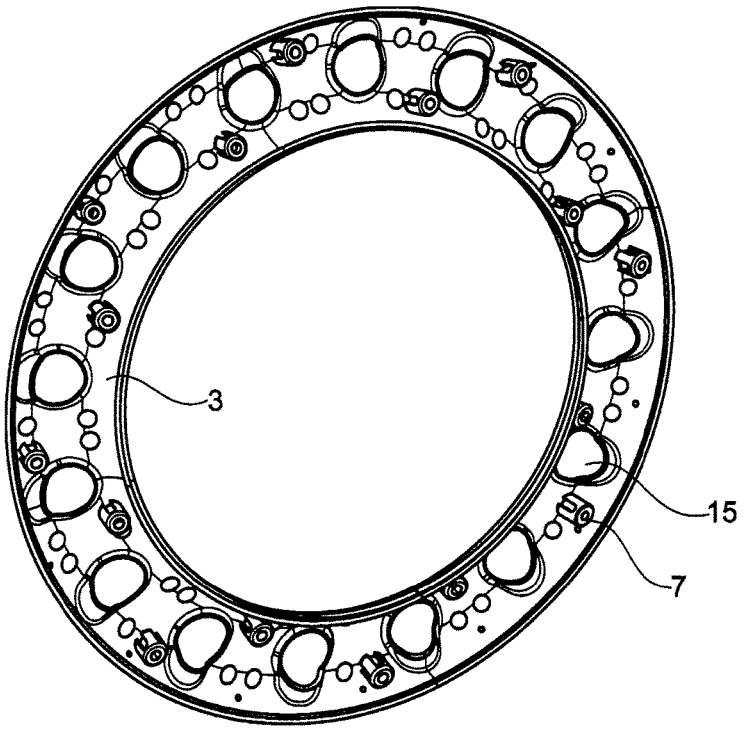

The present invention is described in the following in light of the accompanying drawing showing an exemplary embodiment. In the drawing, FIG. 1 shows a gas-turbine engine for using the gas-turbine combustion chamber in accordance with the present invention, FIG. 2 shows a partial sectional view of an exemplary embodiment of a combustion chamber with the combustion chamber head being attached in accordance with the present invention, FIG. 3 shows a perspective partial view, by analogy with FIG. 2, FIG. 4 shows a perspective view of a segment component of a combustion chamber head in accordance with the present invention, FIG. 5 shows an enlarged representation in accordance with FIG. 4, and FIG. 6 shows an overall view of a combustion chamber head in accordance with the present invention.

The gas-turbine engine 110 in accordance with FIG. 1 is a generally represented example of a turbomachine where the invention can be used. The engine 110 is of conventional design and includes in the flow direction, one behind the other, an air inlet 111, a fan 112 rotating inside a casing, an intermediate-pressure compressor 113, a high-pressure compressor 114, a combustion chamber 115, a high-pressure turbine 116, an intermediate-pressure turbine 117 and a low-pressure turbine 118 as well as an exhaust nozzle 119, all of which being arranged about an engine center axis 101.

The intermediate-pressure compressor 113 and the high-pressure compressor 114 each include several stages, of which each has an arrangement extending in the circumferential direction of fixed and stationary guide vanes 120, generally referred to as stator vanes and projecting radially inwards from the engine casing 121 in an annular flow duct through the compressors 113, 114. The compressors furthermore have an arrangement of compressor rotor blades 122 which project radially outwards from a rotatable drum or disk 125 linked to hubs 126 of the high-pressure turbine 116 or the intermediate-pressure turbine 117, respectively.

The turbine sections 116, 117, 118 have similar stages, including an arrangement of fixed stator vanes 123 projecting radially inwards from the casing 121 into the annular flow duct through the turbines 116, 117, 118, and a subsequent arrangement of turbine blades 124 projecting outwards from a rotatable hub 126. The compressor drum or compressor disk 125 and the blades 122 arranged thereon, as well as the turbine rotor hub 126 and the turbine rotor blades 124 arranged thereon rotate about the engine center axis 101 during operation.

FIG. 2 shows in a simplified sectional view a combustion chamber outer wall 1 and a combustion chamber inner wall 2 which are connected to one another. A combustion chamber head 3 is connected to the combustion chamber outer wall 1, for example by means of a welding method. In the interior of the combustion chamber, a heat shield 4 is arranged which has four heat shield bolts 5 provided with an external thread for screwing on a nut 10.

FIG. 2 furthermore shows a combustion chamber head 3 shown in greater detail in the following figures. The combustion chamber head 3 is designed such that it can be placed with its edge area 12 into a groove 13 of the head plate 6 in a precise fit and hence can be centered. On its inside, the combustion chamber head 3 has fastening sleeves 7 provided with air passage openings 11, as can be seen in particular from the illustration in FIG. 3. The fastening sleeves 7 are designed such that in the fitted state they contact fastening projections 14 of the head plate 6. A bolted connection can then be made by means of nuts 10.

The combustion chamber head 3 is provided with access recesses 8 to permit bolting of the combustion chamber head 3 to the heat shield 4. The combustion chamber head furthermore has access recesses 9 by which access is afforded to the bolting points by means of which the heat shield 4 is bolted to the head plate 6.

FIG. 3 shows a perspective representation of the view shown in FIG. 2. It can be seen here in particular that only some of the heat shield bolts 5 are used for fastening the combustion chamber head 3.

FIGS. 4 to 6 show perspective partial views of the combustion chamber head looking onto the inside of the combustion chamber head 3. It can be seen here that a plurality of burner passage openings 15 is provided on the combustion chamber head 3. Each of these burner passage openings 15 is assigned a heat shield 4, which is bolted on by means of four heat shield bolts 5. While two of these fastening points are used for direct connection of the heat shield 4 to the head plate 6, fastening sleeves are provided at two of these fastening points on the combustion chamber head 3, by means of which sleeves the combustion chamber head 3 is fastened, as shown in FIGS. 2 and 3.

FIGS. 4 and 5 show in particular the air passage openings 11 of the fastening sleeves 7 too.

FIG. 6 shows an overall view of the combustion chamber head 3, which is made up of four segments.

LIST OF REFERENCE NUMERALS

101 Engine center axis
110 Gas-turbine engine/core engine
111 Air inlet
112 Fan
113 Intermediate-pressure compressor (compressor)
114 High-pressure compressor
115 Combustion chamber
116 High-pressure turbine
117 Intermediate-pressure turbine
118 Low-pressure turbine
119 Exhaust nozzle
120 Guide vanes
121 Engine casing
122 Compressor rotor blades
123 Stator vanes
124 Turbine blades
125 Compressor drum or disk
126 Turbine rotor hub
127 Exhaust cone
1 Combustion chamber outer wall
2 Combustion chamber inner wall
3 Combustion chamber head
4 Heat shield
5 Heat shield bolt
6 Head plate
7 Fastening sleeve on combustion chamber head
8 Access recess
9 Access recess
10 Nut
11 Air passage opening
12 Edge area
13 Groove
14 Fastening projection
15 Burner passage opening

What is claimed is:

1. A combustion chamber of a gas turbine comprising:

a combustion chamber wall;

a head plate connected to the combustion chamber wall, the head plate including a plurality of tubular fastening projections facing a combustion chamber head;

the combustion chamber head including a plurality of fastening sleeves projecting into an interior of the combustion chamber head, the plurality of fastening sleeves aligning respectively with the plurality of tubular fastening projections, a plurality of heat shields arranged in an interior of the combustion chamber, a plurality of bolted connections fastening the plurality of heat shields to the head plate, a portion of the plurality of bolted connections each fastening both the combustion chamber head and one of the plurality of heat shields to the head plate, wherein each of the portion of the plurality of bolted connections includes a cylindrical shaft portion connected to the one of the plurality of heat shields and passing through a respective one of the plurality of tubular fastening projections into a respective one of the plurality of fastening sleeves and the each of the portion of the plurality of bolted connections causes the respective one of the plurality of tubular fastening projections to engage the respective one of the plurality of fastening sleeves.

2. The combustion chamber in accordance with claim 1, wherein the portion of the plurality of bolted connections each fastening both the combustion chamber head and the one of the plurality of heat shields to the head plate is fewer than the plurality of bolted connections fastening the plurality of heat shields to the head plate.

3. The combustion chamber in accordance with claim 2, wherein the combustion chamber head includes access recesses for access to the plurality of bolted connections.

4. The combustion chamber in accordance with claim 1, wherein the fastening sleeves include air passage openings.

5. The combustion chamber in accordance with claim 4, wherein the combustion chamber head is formed as a complete ring.

6. The combustion chamber in accordance with claim 4, wherein the combustion chamber head is formed by a plurality of separate segments.

7. The combustion chamber in accordance with claim 1, wherein the combustion chamber head is manufactured by additive production.

8. The combustion chamber in accordance with claim 1, wherein the combustion chamber head includes access recesses for access to the plurality of bolted connections.

9. The combustion chamber in accordance with claim 8, wherein the fastening sleeves project into the interior of the combustion chamber head, in an area of the access recesses.

10. The combustion chamber in accordance with claim 9, wherein the fastening sleeves include air passage openings.

11. The combustion chamber in accordance with claim 10, wherein the combustion chamber head is formed as a complete ring.

12. The combustion chamber in accordance with claim 10, wherein the combustion chamber head is formed by a plurality of separate segments.

13. The combustion chamber in accordance with claim 1, wherein the fastening sleeves include air passage openings.

14. The combustion chamber in accordance with claim 1, wherein the combustion chamber head is formed as a complete ring.

15. The combustion chamber in accordance with claim 1, wherein the combustion chamber head is formed by a plurality of separate segments.

* * * * *